US005207833A

United States Patent [19]

Hart

[11] Patent Number: 5,207,833

[45] Date of Patent: May 4, 1993

[54] LINE TRAVEL SPRAY COATING DEVICE

[75] Inventor: Milburn L. Hart, Tulsa, Okla.

[73] Assignee: Commercial Resins Company, Tulsa, Okla.

[21] Appl. No.: 800,077

[22] Filed: Nov. 29, 1991

[51] Int. Cl.[5] ..... B05C 1/04

[52] U.S. Cl. ..... 118/307; 118/313; 118/323; 118/DIG. 11; 239/752

[58] Field of Search ..... 118/254, 306, 307, 313, 118/317, 323, DIG. 10, DIG. 11; 239/752

[56] References Cited

U.S. PATENT DOCUMENTS 2,535,451 12/1950 Phillips ..... 118/DIG. 11
4,595,607 6/1986 Betteridge ..... 118/316
4,953,496 9/1990 Taylor et al. ..... 118/323

*Primary Examiner*—W. Gary Jones
*Assistant Examiner*—Charles K. Friedman
*Attorney, Agent, or Firm*—William S. Dorman

[57] ABSTRACT

The invention is a spray coating machine for applying a protective coating to a pipe or pipeline as the machine travels down the pipe. The invention has a two piece yoke which separates at the top and bottom to enable it to be fitted around the pipe. Each of the two pieces of the yoke serve as a track on which a spray gun moves, one spray gun flexibly mounted on each of the two pieces of the yoke. The two spray guns are aimed at the pipe and are moved up and down opposite each other by means of a gear belt driven mechanism. The spray guns are controlled so that they spray during only one direction of travel and are turned off as they travel in the opposite direction.

9 Claims, 6 Drawing Sheets

LINE TRAVEL SPRAY COATING DEVICE

BACKGROUND OF THE INVENTION

1. Field of the Invention

The present invention relates to a device for spraying coating onto a pipe. Specifically, the invention relates to a device having a yoke which can be releasably mounted around a pipe or pipeline, and once mounted, the device travels longitudinally along the pipeline spraying a continuous layer of coating onto the exterior surface of the pipe. The device applies the coating in a helical pattern utilizing spray guns which move on the yoke in opposite reciprocating arcs of approximately 180 degrees, with each spray gun spraying only while moving in one direction, i.e. either clockwise or counterclockwise, on the yoke.

2. The Prior Art

Preliminary searches were conducted on the invention disclosed herein, and the following patents were uncovered in the searches:

| U.S. Pat. No. | Inventor | Issue Date |
|---|---|---|
| 2,535,451 | Phillips | Dec. 26, 1950 |
| 2,583,819 | Cummins | Jan. 29, 1952 |
| 2,613,635 | MacWilliam | Oct. 14, 1952 |
| 3,107,183 | Way | Oct. 15, 1963 |
| 3,386,414 | Faber | June 4, 1968 |
| 3,654,898 | Galitz | Apr. 11, 1972 |
| 4,038,942 | Hart | Aug. 2, 1977 |

Many spray coating devices operate by coordinating a moveable spray gun on the device with a moveable object to be coated. An example of this type of device can be found in U.S. Pat. No. 3,654,898 where the spray gun moves linearly in the direction opposite to the direction of travel of the object to be coated. Such a device is limited to use with small objects which can be moved easily and is not appropriate for coating larger objects, such as pipelines, where moving the object is impractical, if not impossible.

A variation of this initial concept is to permanently mount spray guns on a moveable yoke, and then move the yoke longitudinally along the object to be coated. Such a design can be found in U.S. Pat. No. 2,535,451 which discloses a device with multiple spray guns mounted around a yoke for coating smoke stacks, grain elevators, and the like. This design has several problems when employed to coat a horizontal pipeline.

First, the large number of spray guns on the yoke increase the probability that a spray gun will become clogged which, if not corrected, would create a break in the coating. On a pipeline, such a break in the coating would expose the uncoated strip on the pipe to corrosion and result in reduced service life of the pipe.

Even if the clogged spray gun was promptly discovered, correcting the break in the coating would be time consuming, particularly because the pipe normally must be inductively preheated immediately prior to applying the coating and the coating device is not designed to spray only one strip of coating onto the pipe. Therefore, it would be difficult to keep the device properly positioned in order to create the proper spray overlap with the previously coated section of the pipe.

Second, the permanent mounting of the spray guns on the yoke limits the flexibility to adjust overlap of spray between the spray guns and limits control of the thickness of the coating being applied. To insure adequate coverage, sufficient overlap must be provided between the spray guns. Adjacent spray guns spray coating on the surface simultaneously in the overlap regions and overlap regions which are horizontal in relationship to the pipe create the problems of solvent inclusion and runs in the coating. Solvent inclusion prevents the coating from drying properly and runs cause non-uniform coating thicknesses.

Drips resulting from application of excess coating in the overlap regions are also expensive due to the cost of wasted coating material. U.S. Pat. No. 2,583,819 provides a drip pan designated by numeral 77 for catching and recycling coating which drips off the pipe. Although recycling of coating is a way to reduce the cost of some types of coating materials, it is not possible to recycle coatings which are formed by mixing two components at the spray gun where those components set up quickly after being mixed and sprayed onto a heated pipe.

The remaining patents listed above are not considered sufficiently pertinent as to require any comment.

The present invention is superior to the prior art in that it is lighter in weight, easier to position on the pipe, and has fewer spray guns to clog. Further, the present invention has greater flexibility than the prior art in that the thickness of coating can be controlled and adjusted by varying the travel speed of the device, varying the speed of the spray guns, and varying the width of the spray pattern applied by the spray guns.

The invention's operation which provides closer control capability and a time interval between application of spray patterns on the pipe tends to minimize the problem of solvent inclusion. Also these same factors, in conjunction with spray overlap regions which are diagonal in relationship to the pipe, tend to eliminate the problems of runs and drips in the coating.

SUMMARY OF THE INVENTION

The coating device has a front end and a back end. The back end has a circular yoke which is made of two halves, a left half and a right half. An overspray collector pan assembly is located behind the circular yoke. The two halves of the yoke are flexibly mounted to the coating device. Each half has an upper end, a lower end, a front side and a back side. The upper ends releasably fasten together and the lower ends releasably fasten together to form a complete circle around the pipe. The left and right halves are provided with gear belt pulleys located between the front and back sides of the halves which provide a path on which a left gear belt and right gear belt can move. The left and right gear belts are provided with means for turning them back and forth on the path. Movement of the gear belts is coordinated by means of a lower gear belt. A left spray gun is flexibly attached to the left gear belt by means of a left bracket. A right spray gun is attached to the right gear belt by means of a right bracket opposite the left spray gun at a position 180 degrees from the left spray gun. The spray guns are mounted facing the pipe and are provided with retractable spray deflectors which can be positioned between the spray guns and the pipe. The edges of the yoke have lips which form tracks engagable by rollers attached to the left and right brackets. The upper ends and lower ends of the halves are provided with wedge-shaped risers which attach to the lipped edges of the yoke which are engagable by rocker arms fastened to the spray guns. The entire device is propelled along the pipe by means of a drive mechanism.

DETAILED DESCRIPTION OF THE PREFERRED EMBODIMENTS

Figure 1:
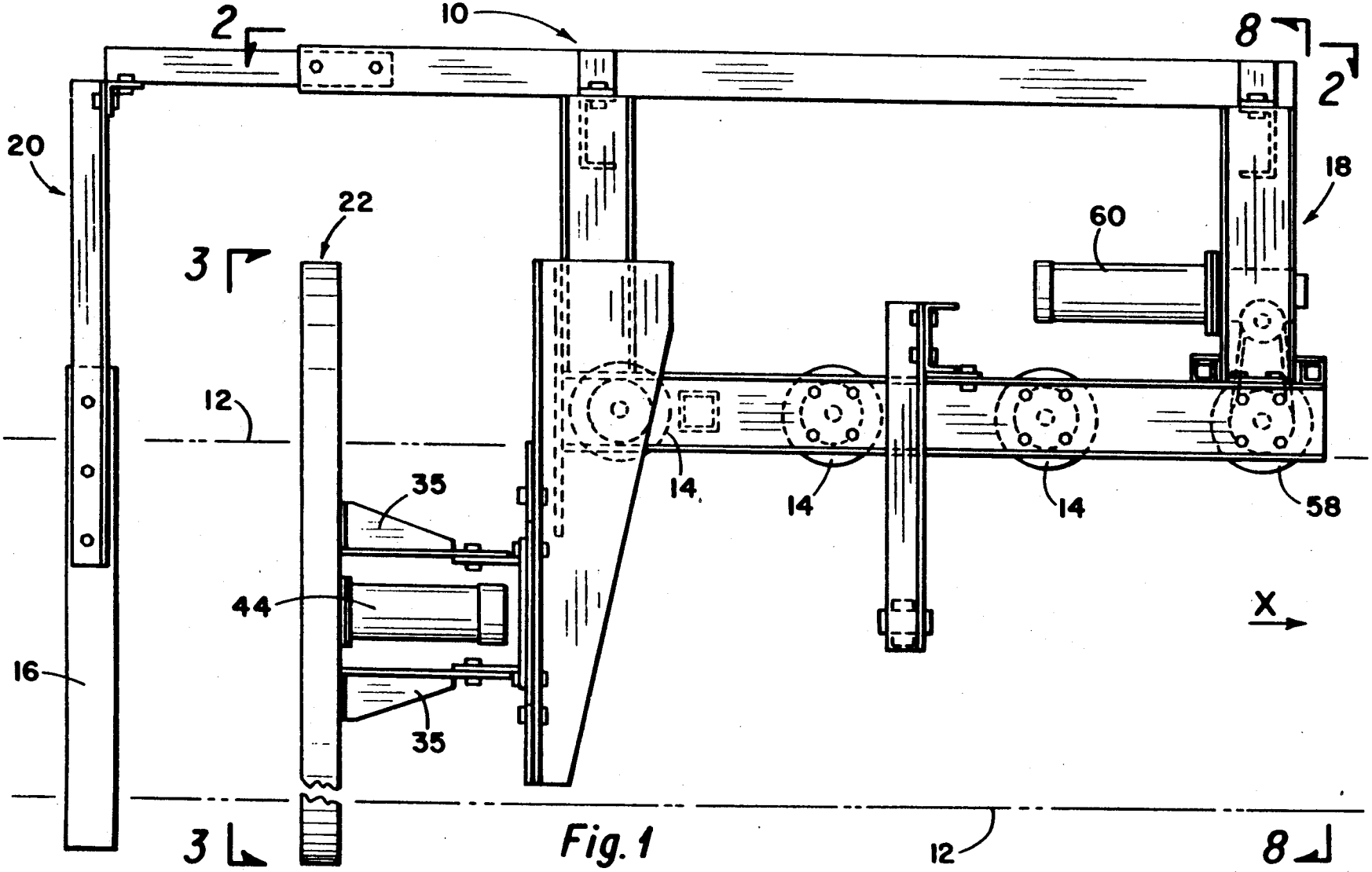
FIG. 1 is a right side elevation of a preferred embodiment of a line travel spray coating device constructed in accordance with the principles of the present invention.
Figure 2:
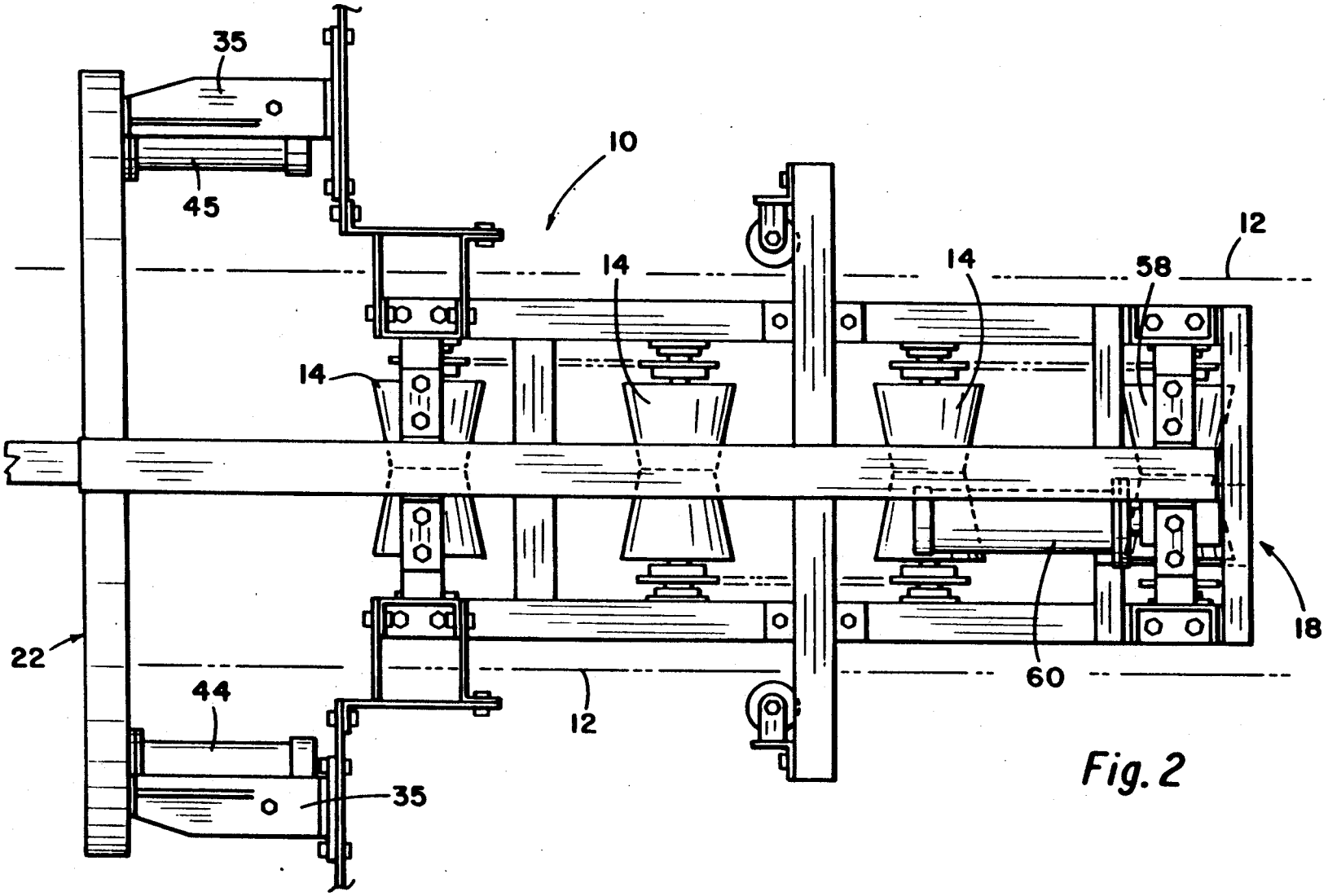
FIG. 2 is top plan view of the line travel spray coating device taken along line 2—2 of FIG. 1.

Referring to the drawings and initially to FIGS. 1 and 2, there is illustrated a line travel spray coating device generally designated by the reference numeral 10. The coating device 10 has a front end 18 and a back end 20. The coating device 10 is shown positioned on a pipe 12 by means of V-shaped rollers 14 located on the device 10. For long sections of pipeline, the pipe 12 may be hoisted out of a ditch in which it lies by a separate hoist (not shown) located ahead of the coating device 10. For shorter sections of pipeline, the pipe 12 may be lifted onto a rolling platform (not shown) on which the pipe 12 rolls as the rolling platform (not shown) rolls along the ground and onto which the coating device 10 can be attached.

Figure 3:
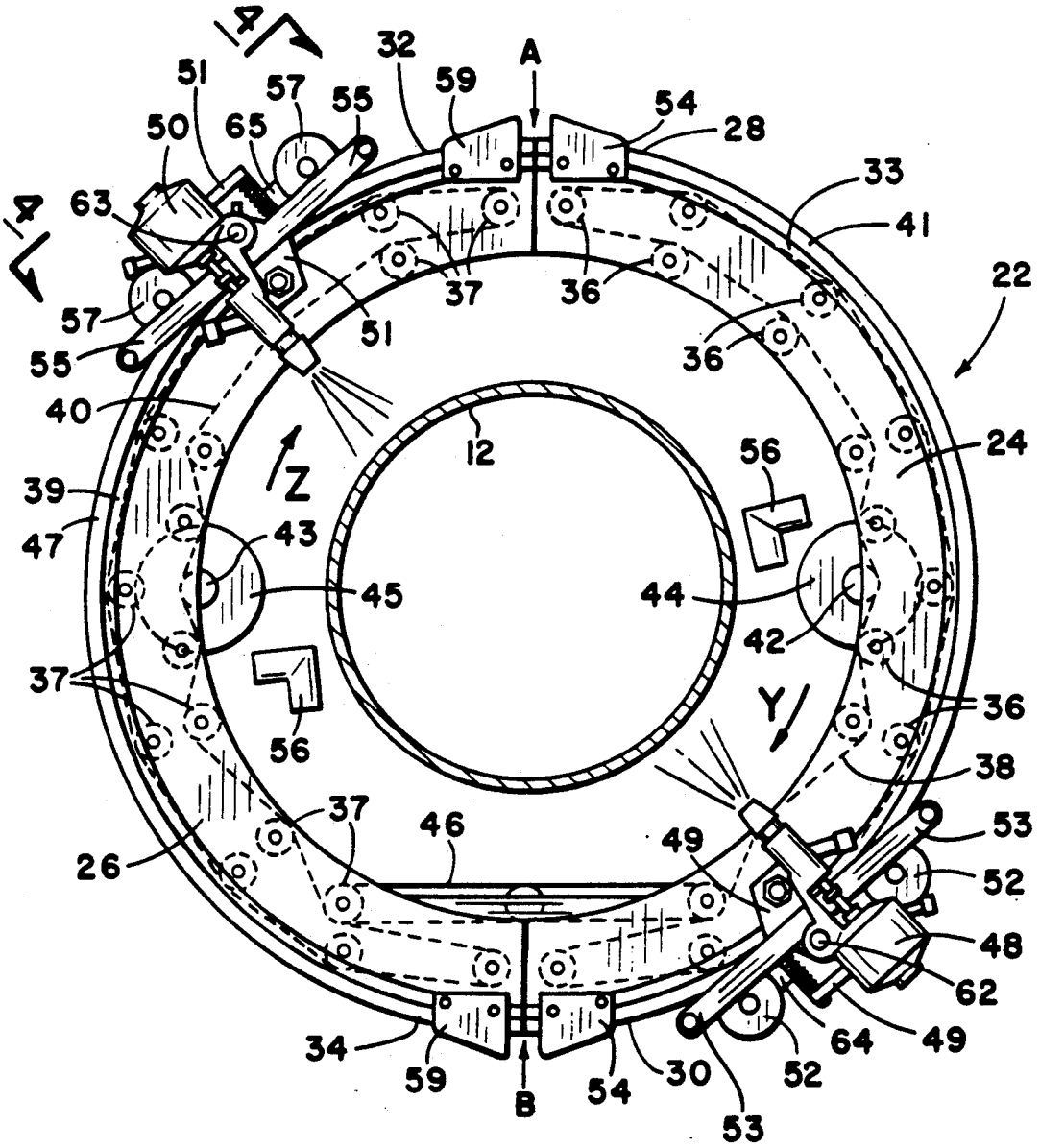
FIG. 3 is a rear elevation showing only the circular yoke portion of the line travel spray coating device taken along line 3—3 of FIG. 1.

Now referring to FIG. 3, the back end 20 of the coating device 10 is provided with an overspray collector pan assembly 16 and a circular yoke 22, both of which mount around the pipe 12, the circular yoke 22 being located in front of the overspray collector pan assembly 16 and between the overspray collector pan assembly 16 and all other portions of device 10.

Now referring to FIG. 3, the circular yoke 22 is made in two halves to facilitate mounting on the pipe 12, a left half 24 and a right half 26. Right and left hand orientations are designated from the viewpoint of an observer positioned at the front end 18 of the coating device 10. The left half 24 has an upper end 28 and a lower end 30, and the right half 26 has an upper end 32 and a lower end 34. Each of the two halves has a front surface (not shown) which faces toward the front end 18 of the device 10 and a back surface (not shown) which faces toward the back end 20 of the device 10. Each of the two halves 24 and 26 are attached to the coating device 10 by means of hinges 35, as shown in FIG. 2, which allow the halves 24 and 26 to swing apart so the coating device 10 can be lowered onto the pipe 12. Once the halves 24 and 26 have been placed around the pipe 12, they are swung together so the upper end 28 of the left half 24 releasably fastens to the upper end 32 of the right half 26 at point "A" and the lower end 30 of the left half 24 releasably fastens to the lower end 34 of the right half 26 at point "B".

The left half 24 is provided with left gear belt pulleys 36 located so they are sandwiched between the front surface (not shown) and the back surface (not shown) and arranged in two concentric arcs, one larger than the other, except the topmost and bottommost left gear belt pulleys are located medially between the two concentric arcs near points "A" and "B". A left gear belt 38 engages the left gear belt pulleys 36 and runs on them.

The right half 26 is provided with right gear belt pulleys 37 located so they are sandwiched between the front surface (not shown) and the back surface (not shown) and arranged in two concentric arcs, one larger than the other, except the topmost and bottommost right gear belt pulleys are located medially between the two concentric arcs near points "A" and "B". A right gear belt 40 engages the right gear belt pulleys 37 and runs on them.

The left gear belt 38 is provided with a left drive gear belt pulley 42 located sandwiched between the front surface (not shown) and the back surface (not shown) approximately halfway between points "A" and "B" on the left half 24. Said left drive gear belt pulley 42 causes the left gear belt 38 to move on the left gear belt pulleys 36. Said left drive gear belt pulley 42 is driven by a left motor 44, shown in FIG. 2, attached to the coating device 10.

The right gear belt 40 is provided with a right drive gear belt pulley 43 located sandwiched between the front surface (not shown) and the back surface (not shown) approximately halfway between points "A" and "B" on the right half 26. Said right drive gear belt pulley 43 causes the right gear belt 40 to move on the right gear belt pulleys 37. Said right drive gear belt pulley 43 is driven by a right motor 45, shown in FIG. 2, attached to the coating device 10.

Movement of the left and right gear belts 38 and 40 can be coordinated by means of a lower gear belt 46 which runs on one of the left gear belt pulleys 36 located near the lower end 30 of left half 24 and on one of the right gear belt pulleys 37 located near the lower end 34 of right half 26.

Figure 5:
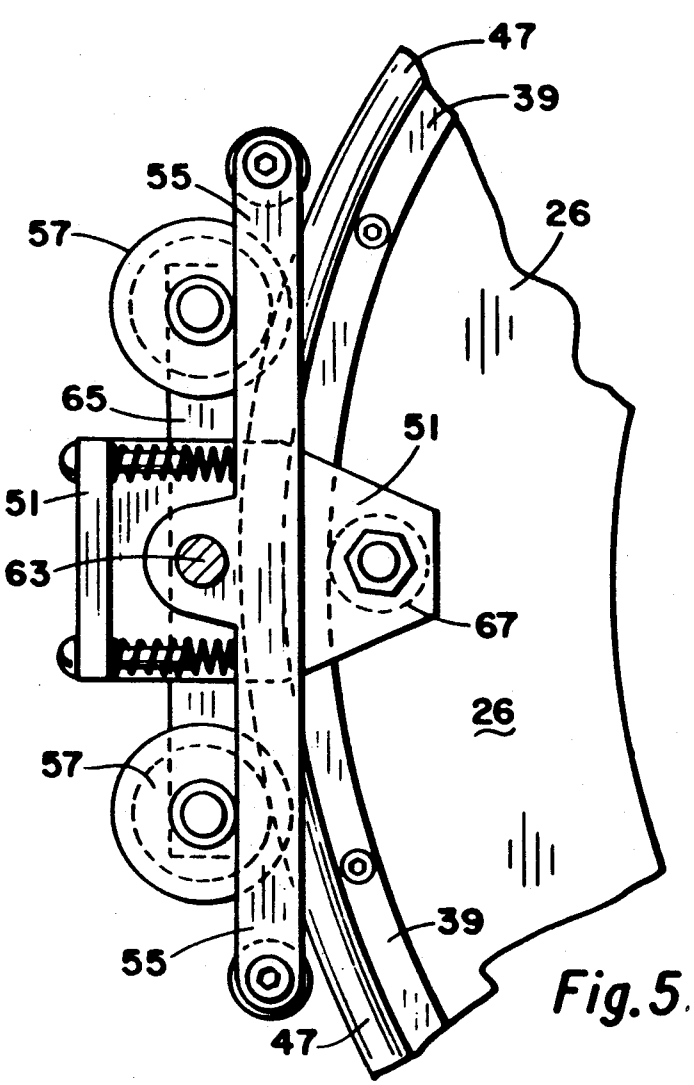
FIG. 5 is a rear elevation of the right roller mechanism taken along line 5—5 of FIG. 4.
Figure 4:
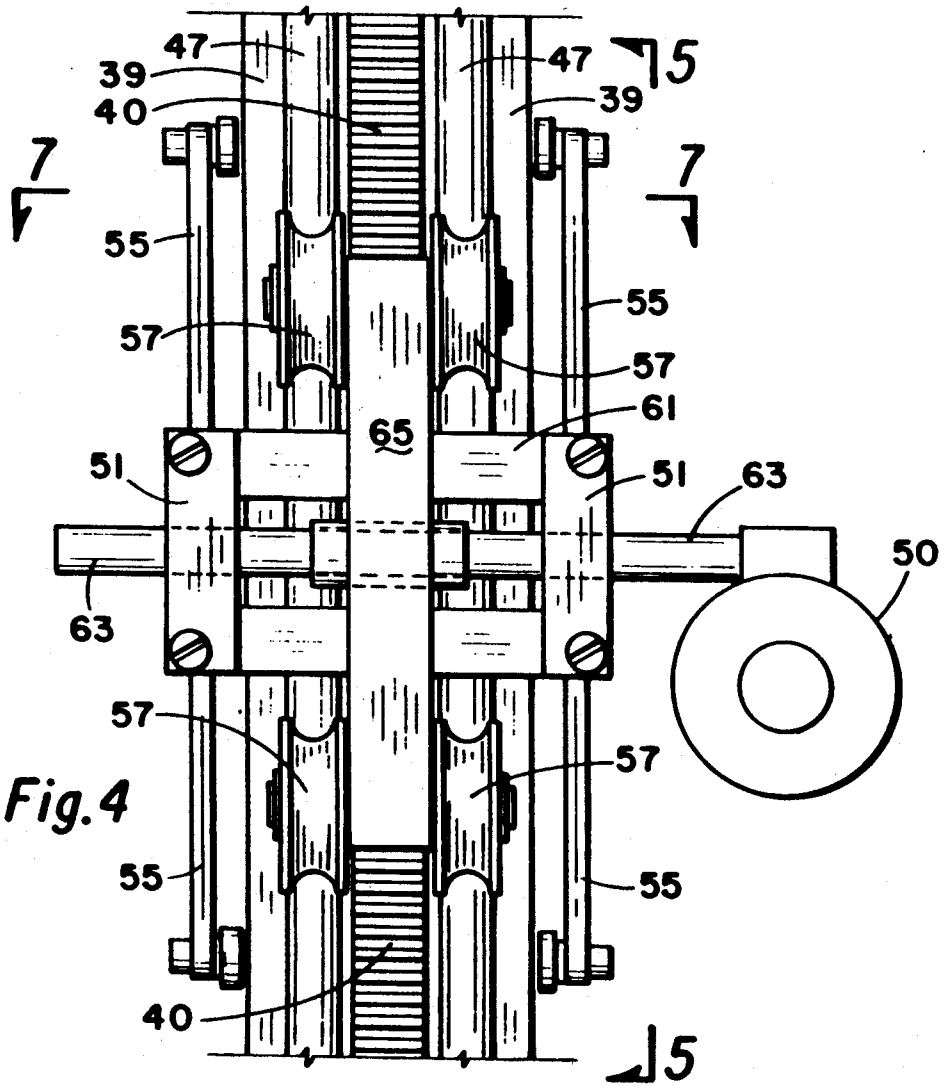
FIG. 4 is a right side elevation of the right spray gun and the right roller mechanism taken along line 4—4 of FIG. 3.

Referring now to FIGS. 3, 4 and 5, the right half 26 has right arced-shaped surfaces 39 located on it furthest from the pipe 12 and facing away from the pipe 12. The right arced-shaped surfaces 39 are provided with right outside dual lipped edges 47 which extend away from the pipe 12.

The left half 24 has left arced-shaped surfaces 33 located on it furthest from the pipe 12 and facing away from the pipe 12. The left arced-shaped surfaces 33 are provided with left outside dual lipped edges 41 which extend away from the pipe 12.

A left spray gun 48 is flexibly mounted via a left rod 62 to a left bracket (not shown) by means of a left spring-loaded gun carriage 49. Said left bracket (not shown) is securely attached to the left gear belt 38. The left spring-loaded gun carriage 49 extends around the left arced-shaped surfaces 33 and is provided with left spacers (not shown) located between the left spring-loaded gun carriage 49 and the left half 24 to hold the left bracket (not shown) in place.

Likewise, a right spray gun 50 is flexibly mounted via a right rod 63 to a right bracket 61 by means of a right spring-loaded gun carriage 51. Said right bracket 61 is securely attached to the right gear belt 40 in such a position so that the spray guns 48 and 50 are located on the gear belts 38 and 40 at 180 degrees from each other. The right spring-loaded gun carriage 51 extends around the right arced-shaped surfaces 39 and is provided with right spacers 67 located between the right spring-loaded gun carriage 51 and the right half 26 to hold the right bracket 61 in place.

The left bracket (not shown) is provided with left roller mechanisms 64 having left rollers 52 which run on the left outside dual lipped edges 41 of the left half 24 of the circular yoke 22. The right bracket 61 is provided with right roller mechanisms 65 having right rollers 57 which run on the right outside dual lipped edges 47 of the right half 26 of the circular yoke 22.

Left rocker arms 53 are attached to the left rod 62 between the left spring-loaded gun carriage 49 and the left spray gun 48. Right rocker arms 55 are attached to the right rod 63 between the right spring-loaded gun carriage 51 and the right spray gun 50.

The left outside dual lipped edges 41 are provided with left wedge-shaped risers 54 at the upper end 28 and the lower end 30 of left half 24. The right outside dual lipped edges 47 are provided with right wedge-shaped risers 59 at the upper end 32 and the lower end 34 of the right half 26.

Figure 6:
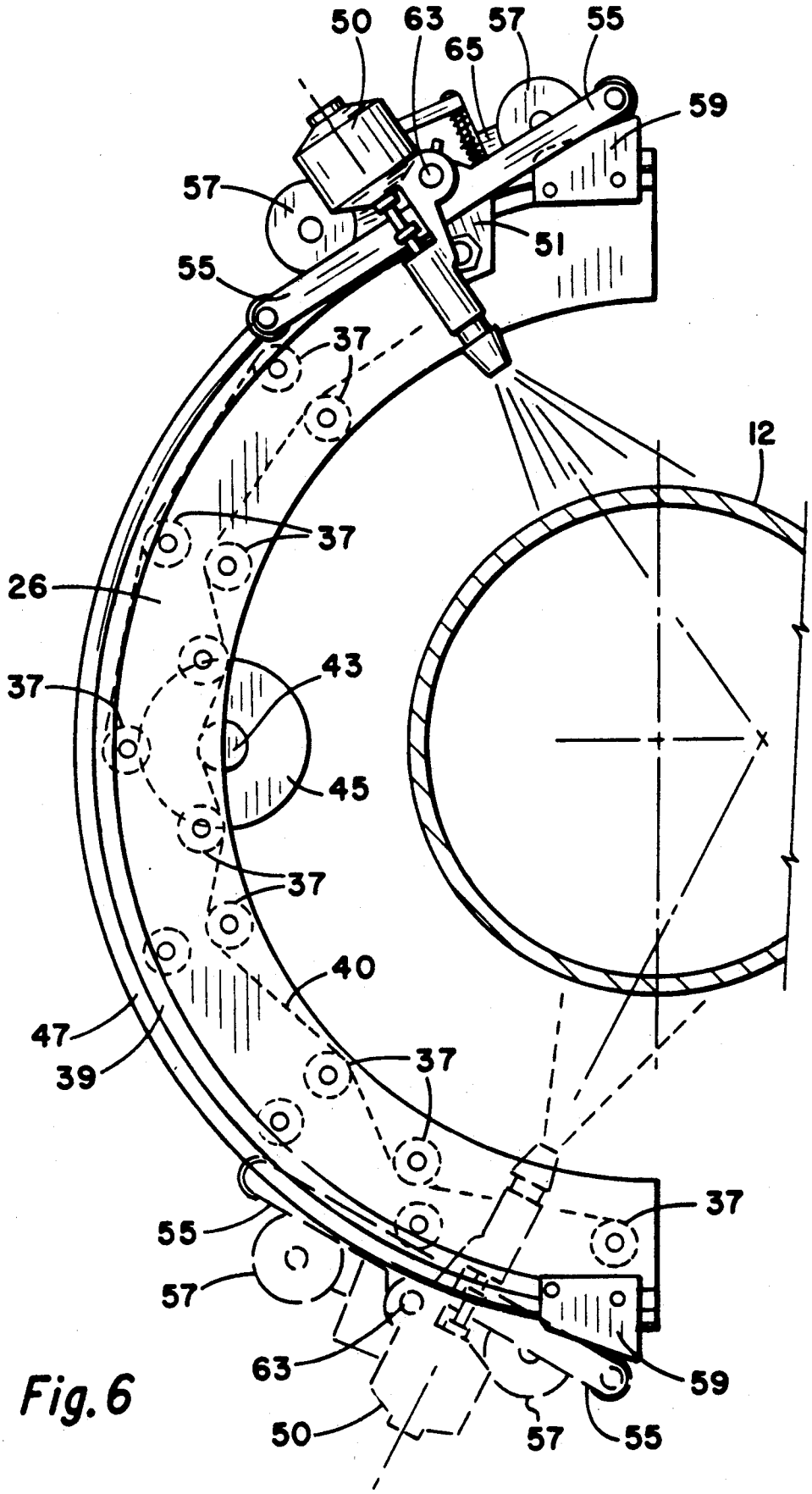
FIG. 6 is an enlarged rear elevation of one half of FIG. 3 showing the maximum travel positions for the right spray gun.
Figure 8:
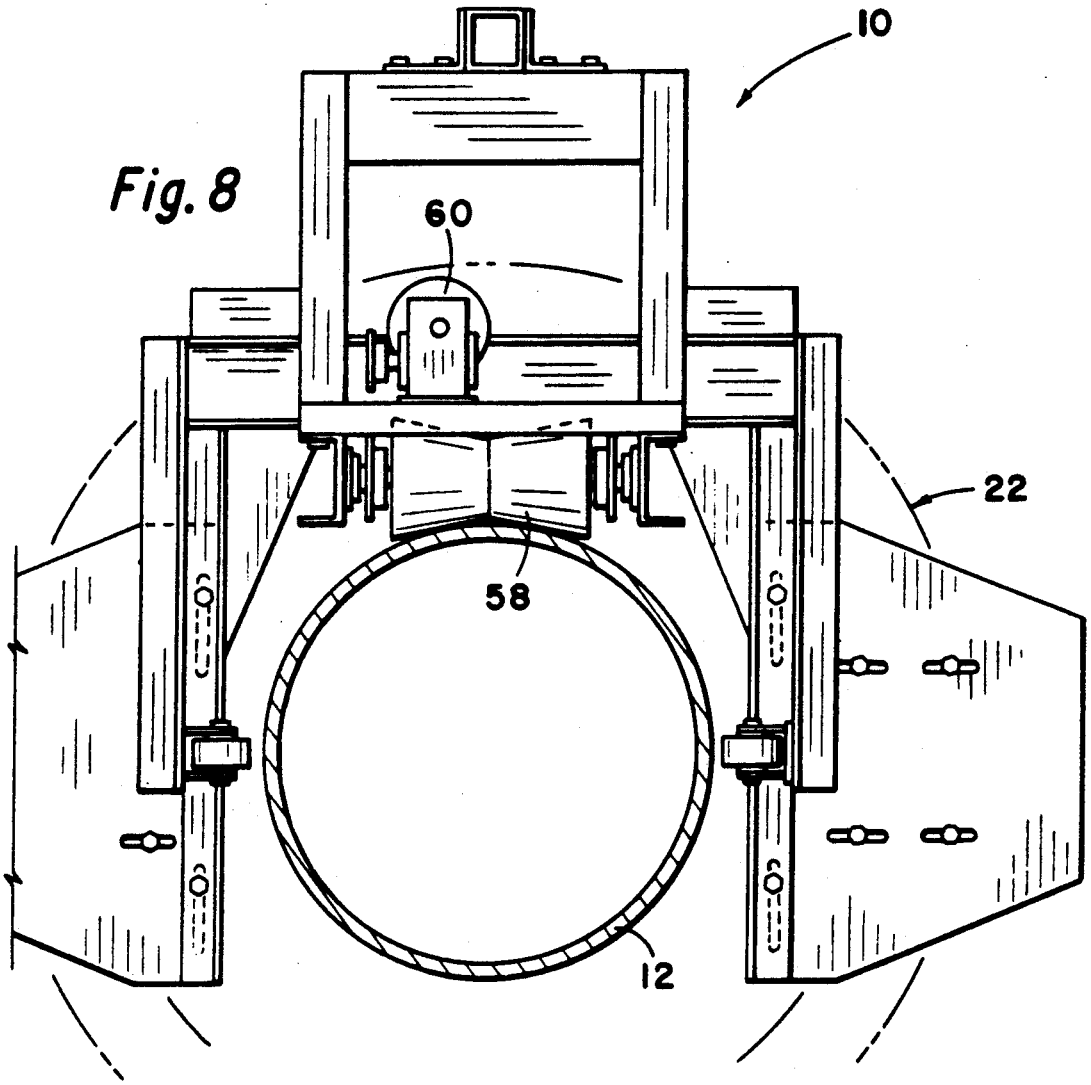
FIG. 8 is a front elevation of the line travel spray coating device taken along line 8—8 of FIG. 1.
Figure 7:
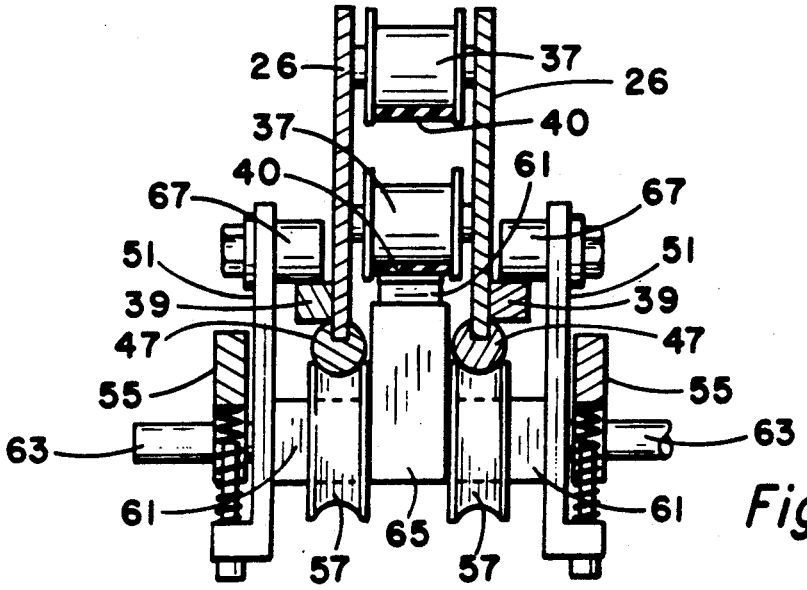
FIG. 7 is a cross sectional view of the right roller mechanism taken along line 7—7 of FIG. 4.

The purpose of the risers 54 and 59 is to tilt the spray guns 48 and 50 at the start and at the end of their spray cycles creating a feathering effect at points "A" and "B" to prevent runs in the coating and create more uniform coverage. The risers 54 and 59 accomplish this purpose by serving as a track with which the left and right rocker arms 53 and 55 engage as the left and right spray guns 48 and 50 approach points "A" and "B", causing the rocker arms 53 and 55 to turn the rods 62 and 63, thus tilting the spray guns 48 and 50. This tilting is shown in FIG. 6 which illustrates the topmost position and bottommost position possible for the right spray gun 50.

Each spray gun 48 and 50 is provided with a retractable spray deflector 56 which can be extended between its associated spray gun, either 48 or 50, and the pipe 12, to enable the spray gun, either 48 or 50, to be flushed by spraying solvent through it. By deflecting the spray, the retractable spray deflectors 56 prevent the solvent from contacting and damaging any coating already applied on the pipe 12.

Paints and solvents are provided to the spray guns 48 and 50 by means of hoses (not shown) running from a trailer (not shown) which travels beside the coating device 10 as the coating device 10 moves down the pipe 12.

The entire coating device 10 is propelled longitudinally along the pipe 12 by means of a propelling motor 60 which drives a variable speed friction drive mechanism 58 which engages the pipe 12.

HOW THE INVENTION WORKS

The coating device 10 travels longitudinally along the pipe 12 in the direction of arrow "X" as shown in FIG. 1. The circular yoke 22 remains stationary relative to the coating device 10 and travels with it along the pipe 12.

At the same time the coating device 10 is traveling longitudinally along the pipe 12, spray guns 48 and 50 rotate in the direction of arrows "Y" and "Z" as shown in FIG. 3. For example, left spray gun 48 is adapted to rotate from the position shown by the letter "A" to the position shown by the letter "B". When it reaches the "B" position, it will reverse its direction of movement and return in the opposite direction to the "A" position. While the left spray gun 48 is moving from "A" to "B" positions, it will be spraying coating material in a path several inches wide along the surface of the pipe 12.

Because the circular yoke 22 is moving in a linear direction along the pipe 12 and the left spray gun 48 is moving in a circular direction with respect to the pipe 12, the resulting path of the coating from the left spray gun 48 will be one-half of a helix, i.e. like one-half of a barber pole stripe.

During the time which left spray gun 48 is spraying, i.e. while moving from the "A" to the "B" position, the right spray gun 50 will be "OFF". When the left spray gun 48 reaches the "B" position it will turn "OFF". In the meantime, the right spray gun 50 will have reached the "A" position at which time it will turn "ON". Thereafter, right spray gun 50 will move counterclockwise from the "A" to the "B" position in the "ON" condition while the left spray gun 48 moves counterclockwise from the "B" to the "A" position in the "OFF" condition. Thus the spray guns 48 and 50 will move alternating clockwise and counterclockwise, and each spray gun 48 and 50 will be in the "ON" condition only while traveling in one direction, thus alternating between the "ON" and "OFF" condition each time it reverses direction of travel. At the moment the right spray gun 50 commences to spray coating onto the pipe 12, it will begin spraying wherever the left spray gun 48 left off and form a continuous coating along the length of the pipe 12.

If the spray guns 48 and 50 are controlled so that they both turn "ON" only as they move clockwise or if they are controlled so they both turn "ON" only as they move counterclockwise, the spray will form a continuous coating with a pattern consisting of two mirror image half-helixes which intersect at lines associated with the linear movement of points "A" and "B" along the length of the pipe 12.

If the spray guns 48 and 50 are controlled so that one is turned "ON" only as it moves clockwise and the other spray gun is turned "ON" only as it moves counterclockwise, a continuous helical stripe of coating will be formed along the length of the pipe 12. However, for the spray guns 48 and 50 to spray simultaneously, an additional pumping system (not shown) would probably be needed so that each spray gun 48 and 50 had its own spray proportioning unit. The separate pumping systems (not shown) would allow regulation of the amount of coating material being pumped to each spray gun 48 and 50, thus producing a uniform coating thickness.

Although not the preferred method, another method of operating the device 10 is to eliminate the lower gear belt 46 which coordinates movement of the left gear belt 38 and the right gear belt 40 and to independently control the operation of the spray guns 48 and 50 by use of the left and right motors 44 and 45. However, when the device 10 is operated without the lower gear belt 46, separate control systems (not shown) are needed to operate each spray gun, 48 and 50.

Regardless of which method of operation is employed, the rate at which the circular yoke 22 moves along the pipe 12 and the rate at which the spray guns 48 and 50 rotate relative to the circular yoke 22 are controlled so that the helical spray will overlap an immediately prior stripe applied on the pipe. The wedge-shaped risers 54 and 59 cause the spray to be feathered at points "A" and "B" where stripes applied by the left spray gun 48 intersect with stripes applied by the right spray gun 50. In this fashion, the pipe 12 will be completely coated by either a helical stripe which slightly overlaps itself, i.e. when one spray gun is turned "ON" when traveling in one direction and the other spray gun is turned "ON" when traveling in the opposite direction, or two mirror images of half-helixes which meet at points "A" and "B", i.e. when one spray gun is turned "ON" when traveling in one direction and the other spray gun is turned "ON" when traveling in the same direction, as circular yoke 22 and the associated coating device 10 move down the pipe 12.

When the spray guns 48 and 50 are to be flushed, the retractable spray deflectors 56 can be extended toward the back end 20 of the device 10 between their associated spray guns 48 and 50 and the pipe 12. The spray guns 48 and 50 will need to be positioned so the retractable spray deflectors 56 contain the flushing spray and divert it away from the pipe 12 which has been freshly sprayed with coating.

The overspray collector pan assembly 16 located behind the circular yoke 22 helps contain any excess spray by preventing it from drifting through the air, thus avoiding an environmental problem.

Whereas, the present invention has been described in particular relation to the drawings attached hereto, it should be understood that other and further modifications, apart from those shown or suggested herein, may be made within the spirit and scope of this invention.

What is claimed is:

1. A device for spraying coating onto the exterior surface of a pipe comprising means for moving the device longitudinally along the pipe, the device having a front end facing in the direction of movement along the pipe and a rear end facing away from the direction of movement along the pipe, a circular yoke mounted on the device at the rear end, said yoke formed from two half circles, a left half and a right half, each half having an upper end and a lower end, said halves movably mounted to the device so the halves can swing apart in order to lower the device over the pipe and swing back together to be fastened at their upper ends and lower ends to encircle the pipe, means for releasably fastening the two halves at their upper ends and means for releasably fastening the two halves at their lower ends to form a continuous circle, the right half provided with right gear belt pulleys which engage a right gear belt and the left half provided with left gear belt pulleys which engages a left gear belt, means for driving the left gear belt back and forth along the left half, means for driving the right gear belt back and forth along the right half, a lower gear belt connecting at least one left gear belt pulley and at least one right gear belt pulley at the lower end of the halves, the left half having left outside dual lipped edges, left roller mechanisms engaging said left outside dual lipped edges, said left roller mechanisms attached to a left bracket, said left bracket fastened to the left gear belt, a left spray gun flexibly mounted to said left bracket, the right half having right outside dual lipped edges, right roller mechanisms engaging said right outside dual lipped edges, said right roller mechanisms attached to a right bracket, said right bracket fastened to the right gear belt, a right spray gun flexibly mounted to said right bracket, the left and right spray guns positioned facing the pipe, and means for controlling the spray guns to turn them "ON" and "OFF".

2. A device according to claim 1 further comprising wedge-shaped risers attached at the upper and lower ends of the halves on the outside dual lipped edges, left rocker arms attached to the left spray gun, right rocker arms attached to the right spray gun, said left and right rocker arms engagable with said wedge-shaped risers.

3. A device according to claim 1 further comprising retractable spray deflectors attached to the device which can be extended between the spray guns and the pipe to deflect spray from the spray guns away from the pipe.

4. A device according to claim 1 wherein the spray guns are flexibly mounted to the brackets by means of spring-loaded gun carriages.

5. A device for spraying coating onto the exterior surface of a pipe comprising means for moving the device longitudinally along the pipe, a yoke mounted on the device, said yoke encircling the pipe, said yoke being in two halves, each half having an upper end and a lower end, each half provided with outside edges, spray guns flexibly engaging said outside edges by means of spring-loaded gun carriages, means for moving the spray guns circumferentially along said outside edges, said spray guns aimed at the pipe, and means for controlling the spray guns to turn "ON" and "OFF".

6. A device according to claim 5 further comprising wedge-shaped risers attached at the upper and lower ends of the halves on the outside edges, left rocker arms attached to the left spray gun, right rocker arms attached to the right spray gun, said right and left rocker arms engagable with said wedge-shaped risers.

7. A device according to claim 5 further comprising retractable spray deflectors attached to the device which can be extended between the spray guns and the pipe to deflect spray from the spray guns away from the pipe.

8. A device according to claim 5 wherein the means for moving the spray guns on the outside edges is by use of belts.

9. A device according to claim 8 wherein the spray guns are flexibly mounted to the belts by means of spring-loaded gun carriages.

* * * * *